US007026958B2

(12) United States Patent
Wainfan et al.

(10) Patent No.: US 7,026,958 B2
(45) Date of Patent: Apr. 11, 2006

(54) METHOD AND SYSTEM OF UTILIZING SATELLITES TO TRANSMIT TRAFFIC CONGESTION INFORMATION TO VEHICLES

(75) Inventors: S. Lynne Wainfan, Long Beach, CA (US); Samuel Lim, Santa Monica, CA (US); Richard T. Riley, Costa Mesa, CA (US)

(73) Assignee: The Boeing Company, Chicago, IL (US)

( * ) Notice: Subject to any disclaimer, the term of this patent is extended or adjusted under 35 U.S.C. 154(b) by 35 days.

(21) Appl. No.: 10/704,393

(22) Filed: Nov. 7, 2003

(65) Prior Publication Data

US 2005/0099322 A1 May 12, 2005

(51) Int. Cl.
*G08B 1/123* (2006.01)

(52) U.S. Cl. ..... 340/995.13; 340/995.1; 340/995.21; 340/995.27; 340/905

(58) Field of Classification Search ..... 340/995.13, 340/995.1, 995.2, 995.21, 995.27, 905
See application file for complete search history.

(56) References Cited

U.S. PATENT DOCUMENTS

| | | | | |
|---|---|---|---|---|
| 6,463,382 | B1 * | 10/2002 | Bullock | 701/117 |
| 6,480,783 | B1 * | 11/2002 | Myr | 701/117 |
| 6,574,556 | B1 * | 6/2003 | Fish et al. | 701/213 |
| 6,650,948 | B1 * | 11/2003 | Atkinson et al. | 700/66 |
| 6,741,926 | B1 * | 5/2004 | Zhao et al. | 701/201 |
| 6,741,932 | B1 * | 5/2004 | Groth et al. | 701/210 |
| 6,785,606 | B1 * | 8/2004 | DeKock et al. | 701/117 |
| 6,868,331 | B1 * | 3/2005 | Hanebrink | 701/117 |

* cited by examiner

*Primary Examiner*—Toan N. Pham
(74) *Attorney, Agent, or Firm*—Gates & Cooper LLP

(57) ABSTRACT

A method and system for collecting and distributing vehicle traffic congestion information is disclosed. The method and system optionally involves deploying probe vehicles or other data sources for collecting and transmitting detailed traffic information which describes vehicle speeds actually being experienced along the routes of interest and transmitting all this information into a central computer at a central traffic data station, where the data are processed.

21 Claims, 6 Drawing Sheets

METHOD AND SYSTEM OF UTILIZING SATELLITES TO TRANSMIT TRAFFIC CONGESTION INFORMATION TO VEHICLES

BACKGROUND OF THE INVENTION

1. Field of the Invention

The present invention relates generally to methods and systems for collecting and distributing traffic congestion information, and in particular to a method and system for distributing formed traffic congestion information about those conditions to a traffic information user and/or forming traffic congestion data based on collected traffic information of a current position and speed.

2. Description of the Related Art

On roadways where a significant proportion of the traffic is attributable to commuters, traffic congestion is a routine problem. In some particularly crowded areas, such as metropolitan areas of the country, traffic during commuter hours slows to a stop. Various methods and systems are known for the metrological collection of data for traffic assessment in segments of a road network Several systems for monitoring traffic and informing motorists of traffic conditions have been used. In some cities, traffic congestion information is gathered electronically by video cameras, radar sets or stationary sensors embedded in pavement, such as copper loop sensors, and then transmitted over a communication network to a central information facility where traffic problems are identified. This information is then augmented by reports of accidents and obstructions from police, fire and emergency services and aerial observers. Traffic information can be sent to one or more message boards located on the roadway to inform drivers of problems, and in certain cases, access to particular segments of roadways can be controlled from the central control center by activating traffic control devices.

The disadvantage with the current method and system is that installing stationary sensors at roadside or in the road surface is expensive, as is the maintenance of such sensors. In addition, the obstacle to gathering the data is getting the required licenses from local, state and federal governments to permanent place sensors on or in roadways.

Given the size of a continental highway system using sensors and/or cameras to collect road traffic information data for each and every public road on the continent is impractical. Considering the technical considerations and the system costs, a method for collecting and distributing dynamic traffic data using equipment installed in vehicles is required.

Automotive onboard navigation systems have become inexpensive and widespread. With steadily decreasing costs for Global Positioning System (GPS), processing and display technology, navigation systems will become universal in coming years. Market research has shown that the most desired service is the augmentation of navigation systems with real-time traffic data, so that a driver is informed of congestion ahead, and alternate, faster routes are provided. Previous efforts to provide individualized real time traffic have relied on cell phone technology or terrestrial wireless to transmit the data on onboard modules, and none has integrated this information into intelligent navigation systems, relying instead on the driver's knowledge of local roads and alternate routes. Moreover, these systems have been limited to specific areas.

There is a significant need for accurate, real-time traffic congestion information. Hence, those skilled in the art have recognized the desirability of a traffic congestion information system which provides a sufficient amount of current and accurate information concerning traffic conditions. There is therefore a need to use low power wireless transmitters to transmit GPS generated automobile location and speed data to a network of receivers located along roadways in congested areas. It has also been recognized that it would be desirable to provide real-time traffic congestion information in a form which allows either an automated system or a driver to devise alternative routes to get around the congested area. Real-time traffic maps are available on desktop computers via Internet, but are not available in a useful form to mobile users. The bandwidth to transmit maps is too high. The drivers shouldn't be working on the map while driving, the best-route information should be via visual or voice to drivers. Also, traffic accident reports are available to mobile users, but do not accurately reflect true traffic speeds. The present invention satisfies that need.

SUMMARY OF THE INVENTION

The present invention is a traffic information distribution and optionally collection system, where the system gathers traffic congestion data and transforms the data into a useable real-time description of traffic congestion. The system involves deploying probe vehicles for collecting and transmitting detailed traffic information which describes vehicle speeds actually being experienced along the routes of interest and transmitting all this information into a central computer at a central traffic data station, where the data are processed.

Low power unlicensed wireless communication transmitters are utilized to transmit position and speed information of a probe vehicle. The transmitters have a range of approximately two miles, so even the city of Los Angeles, with the most extensively built out highway system in the United States, will require less than 200 receiving stations placed at intervals along a roadway of interest. By installing tracking devices in fleets of rental, police and delivery vehicles, as well as trucks and busses, the present invention obtains large enough samples to build an accurate traffic congestion information database.

The traffic information congestion and distribution system provides real-time traffic congestion information to drivers of vehicles equipped with suitable digital radio receivers and navigation systems. The distribution of traffic information is directly to vehicles over digital satellite transponders. An improved traffic information congestion and distribution system comprises an arrangement which provides real-time traffic congestion information data via satellite to drivers of vehicles equipped with a digital radio receiver and navigation system. The traffic information is delivered via digital radio satellites and extracted from automotive digital radio receivers via the data port built into the radio. A data cable will deliver the data to a portable or built-in navigation system, processed and delivered to the driver by synthesized voice and/or visual display for avoiding the areas of traffic congestion.

The traffic congestion data are collected in a plurality of moving or probe vehicles that travel in traffic and are equipped with tracking devices for data collection. The transmitters can conserve the limited bandwidth available by only transmitting their speed and position information when they encounter a deviation from the expected traffic speed at their location. In a preferred embodiment, most or all of the probe vehicles are motor vehicles which are expected to be routinely traveling the desired roadway route segments while conducting normal business. Each vehicle is equipped with a transmitter for transmitting to a plurality of receiving stations along a roadway of interest. Operation is fully automatic, the tracking device being linked to the ignition system and/or transmission controls or uses other forms of detection, so that it transmits only when the vehicle is being driven. This embodiment involves the lowest possible long term operating costs, because no or only a few probe vehicle communications are required.

It is an object of the present invention to provide a traffic information congestion and distribution system that effectively assists a driver to avoid traffic congestion.

It is also an object of the present invention to provide a best-route information that can be computed by a navigation system to offer advice to a driver pertaining to faster route options via visual or audio.

It is an additional object of the present invention to provide a system and method for assimilating traffic congestion data and transforming the data into an efficient, unified form, transmitting the unified data to a navigation system, and processing and formatting the unified data into useful congestion information in the vehicle for presentation to the vehicle's driver.

It is a further object of the present invention to provide a method and system for processing traffic condition data of disparate types and differing levels of reliability to produce congestion information related to specific sections of roadway.

It is still a further object of the present invention to provide a method and system for processing traffic congestion information in a motor vehicle so that only the congestion information which is relevant to the vehicle's particular location and heading is displayed to the driver.

It is still a further object of the present invention to provide a traffic information congestion and distribution system which can be used in conjunction with existing vehicle navigation systems in order to provide the vehicle's location and heading autonomously to the system.

It is still a further object of the present invention to provide a traffic data collection and intelligent vehicle route planning system.

Further novel features and other objects of the present invention will become apparent from the following detailed description, discussion and the appended claims, taken in conjunction with the drawings.

BRIEF DESCRIPTION OF THE DRAWINGS

Referring now to the drawings in which like reference numbers represent corresponding parts throughout.

DETAILED DESCRIPTION OF PREFERRED EMBODIMENTS

In the following description of the preferred embodiment, reference is made to the accompanying drawings, which form a part hereof, and in which is shown byway of illustration a specific embodiment in which the invention may be practiced. It is to be understood that other embodiments may be utilized and structural changes may be made without departing from the scope of the present invention.

Figure 1:
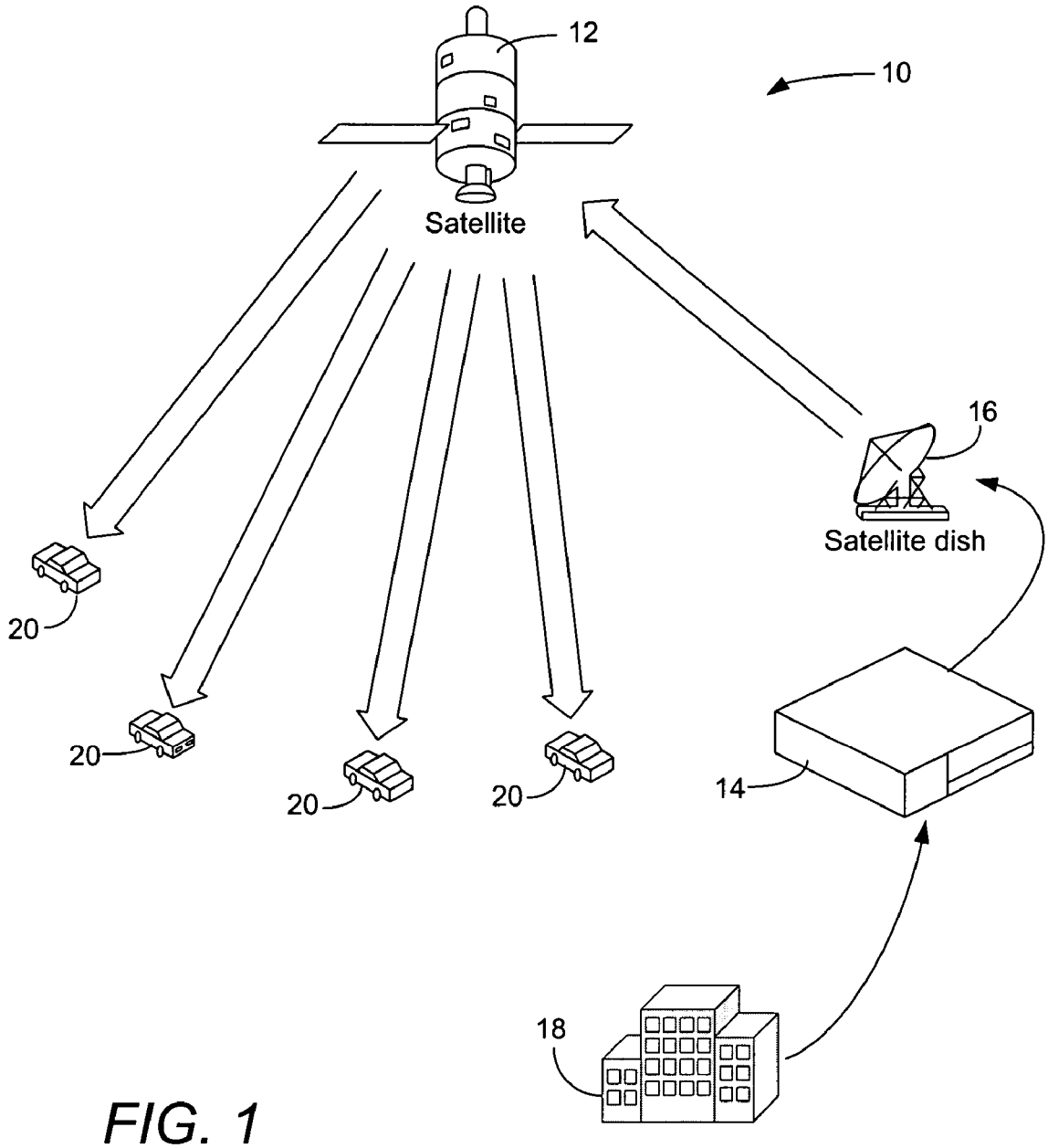
FIG. 1 is an illustration of a traffic congestion information distribution system in accordance with the present invention.

FIG. 1 illustrates one embodiment of a traffic congestion information distribution system 10 in accordance with the present invention. The traffic distribution system 10 includes at least one digital radio satellite 12, a network operation center and uplink station 14 with a satellite dish 16, a central traffic information station 18, and a group of traffic information user vehicles or mobile users 20 which travel segments of a road network which may be a metropolitan highway system, a regional highway system, national expressway system or a cross-continent expressway system. The satellite 12 accepts uplink information from the network operation center and uplink station 14 via the satellite dish 16. This information is processed, if necessary, and transmitted via a digital transponder to one or more vehicles 20. The real-time traffic information is transmitted to the central information station 18 by probe vehicles or other traffic information sources such as traffic sensors on the roadway. These traffic information sources provide real-time traffic information to the mobile users 20 via the satellite 12. As illustrated in FIG. 1, the arrows directed from the satellite 12 to the mobile users 20 represent downlink channel transmissions and the arrow directed from the satellite dish 16 to the satellite 12 represents an uplink channel transmission. These channel transmissions travel in one direction as shown.

Figure 2:
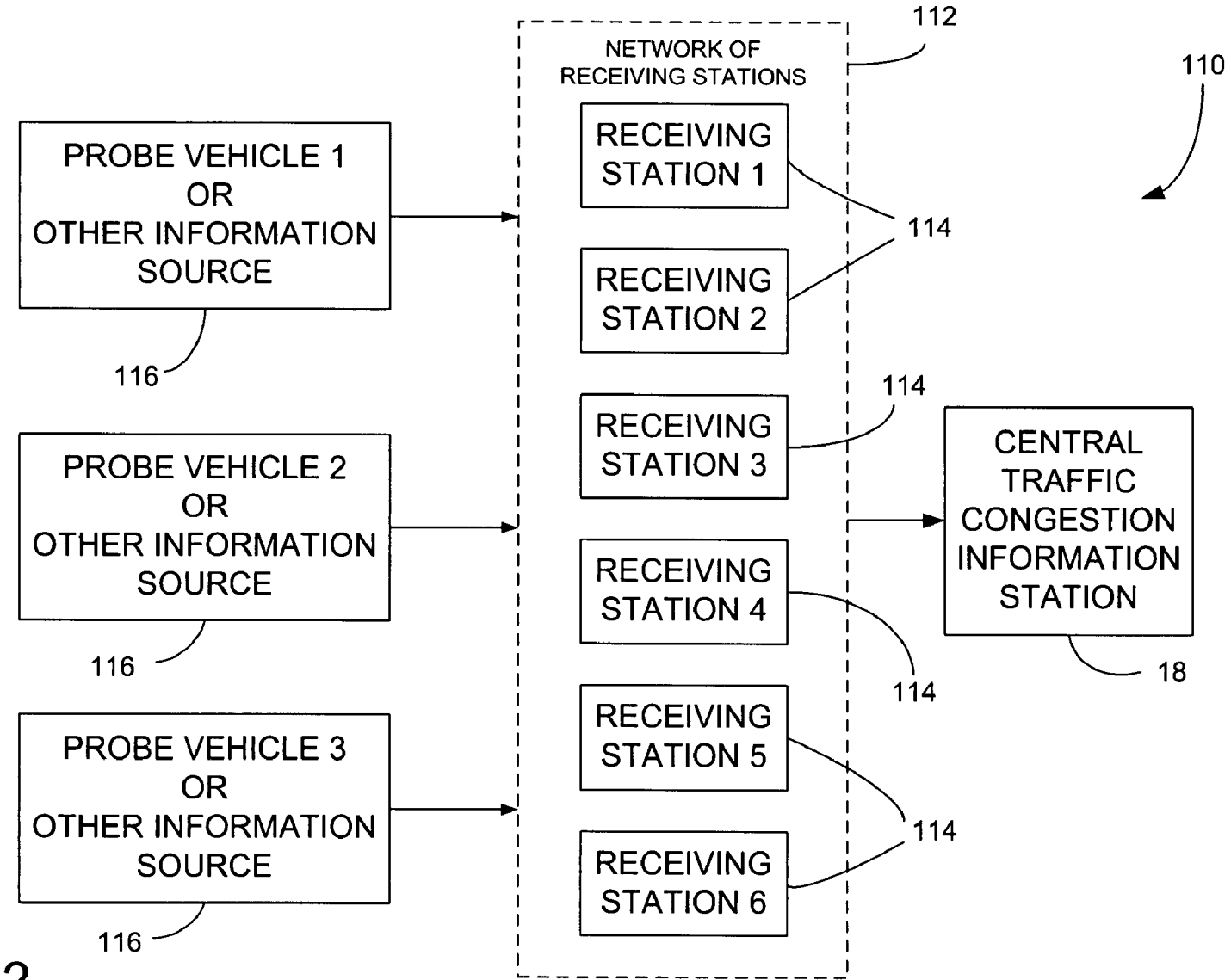
FIG. 2 is a block diagram of a traffic congestion information collection system in accordance with the principles of the present invention showing six traffic receiving stations disposed along segments of a road network of interest, a central traffic information station and three probe vehicles.

FIG. 2 is a block diagram of one embodiment of a system 110 for collecting traffic congestion data in accordance with the present invention, which generally comprises a network 112 of traffic receiving stations 114 (only six are shown) spaced apart from each other by approximately two miles, or at some other informative interval, a central traffic congestion information station 18 which may be a land based transmitter, and a plurality of probe vehicles or other traffic information sources 116 (only three are shown). The receiving stations 114 are located along a roadway of interest, such as an interstate freeway or the like. Each probe vehicle 116 transmits speed and location information to a respective one of the plurality of receiving stations 114 in the network 112 and forwards those speed and location information to the central traffic information station 18. During the collecting information phase, a relatively large number of vehicles 116 will be equipped so that they can serve as probe vehicles. Desirably, these probe vehicles 116 are selected because they will normally or frequently be operating on routes of interest independent of their status as probe vehicles. By way of example, commuter buses, delivery vehicles, or private automobiles are frequently used for commuting. Fleet operators that wish to track their vehicles more closely would, for a fee, have units that would also transmit their location at regular intervals regardless of their location.

Figure 3:
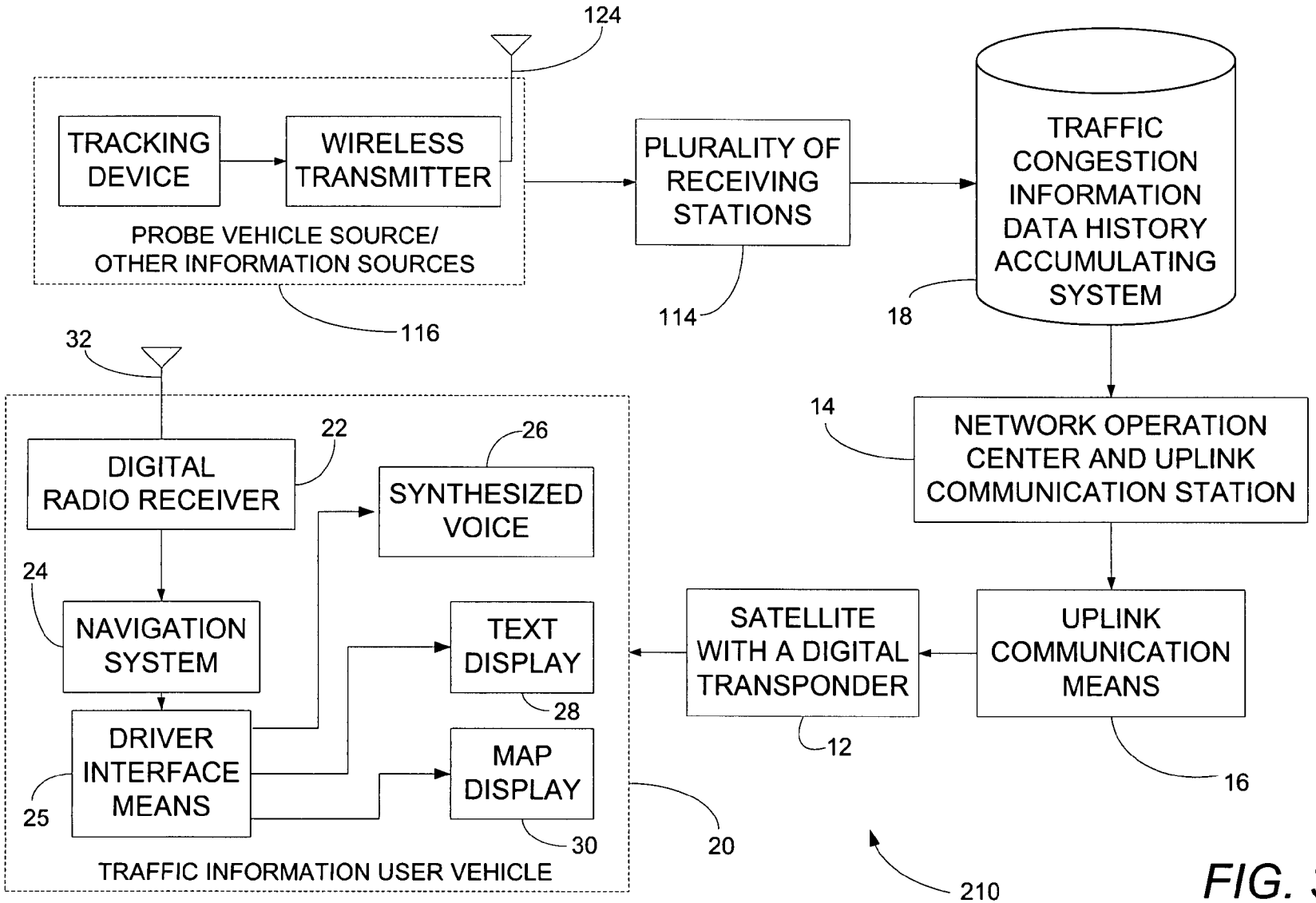
FIG. 3 is a block diagram of a preferred embodiment of the present invention traffic congestion information collecting and distributing system.

FIG. 3 is a block diagram of a traffic congestion information collection and distribution system 210 in accordance with the present invention. Each probe vehicle 116 includes a tracking device 120 and a low power wireless transmitter 122 which is coupled to the tracking device 120. The tracking device 120 detects the speed and location information of the probe vehicle 116 and forwards the speed and location information by means of the transmitter 122 and an antenna 124 to a respective one of the plurality of receiving stations 114 of the traffic congestion existing at a particular location. The central traffic congestion information station 18 receives and stores the speed and location information for the particular location of the receiving station. The tracking device 120 may include a speed sensor means for detecting speed information and a locating means for locating position information.

The central traffic congestion information station 18 transmits the traffic congestion data history to the network operation center and uplink communication station 14, where it uplinks to the satellite 12 via the satellite dish 16. The satellite 12 has a digital transponder which transmits the traffic congestion data history to a digital radio receiver 22 located within a traffic information user vehicle 20. Each traffic information user vehicle 20 includes the automotive digital radio receiver 22, an antenna 32 and a portable or built-in navigation system 24. A cable is connected between the receiver 22 and the navigation system 24, processed and delivered to the driver by synthesized voice 26, text display 28 and map display 30.

The navigation system 24 on each vehicle 20 receives the traffic congestion information from the central traffic information station 18 and processes information included in the traffic congestion information broadcast to provide route planning to the driver by recommending real-time optimum travel routes based on real-time traffic congestion information. The traffic congestion information received by the navigation system 24 may be reported to the driver by any combination of three methods. By way of example, in accordance with the preferred embodiment of the present invention, congestion information is superimposed on a map overlay and reported by a driver interface device 25. Byway of example, utilizing a second method, the congestion information is displayed as text messages by the driver interface device 25 or on an appropriate alternate display. By way of example, utilizing a third method, audio messages may be generated by the navigation system 24 and played over the vehicle's radio speaker (or a dedicated speaker) in order to warn a driver about impending traffic congestion. The driver interface device 25 permits drivers to receive and interact with the navigation system 24. The navigation system 24 further includes a road program executed by a computer system, adapted to provide a best route information using the traffic congestion data.

Figure 4:
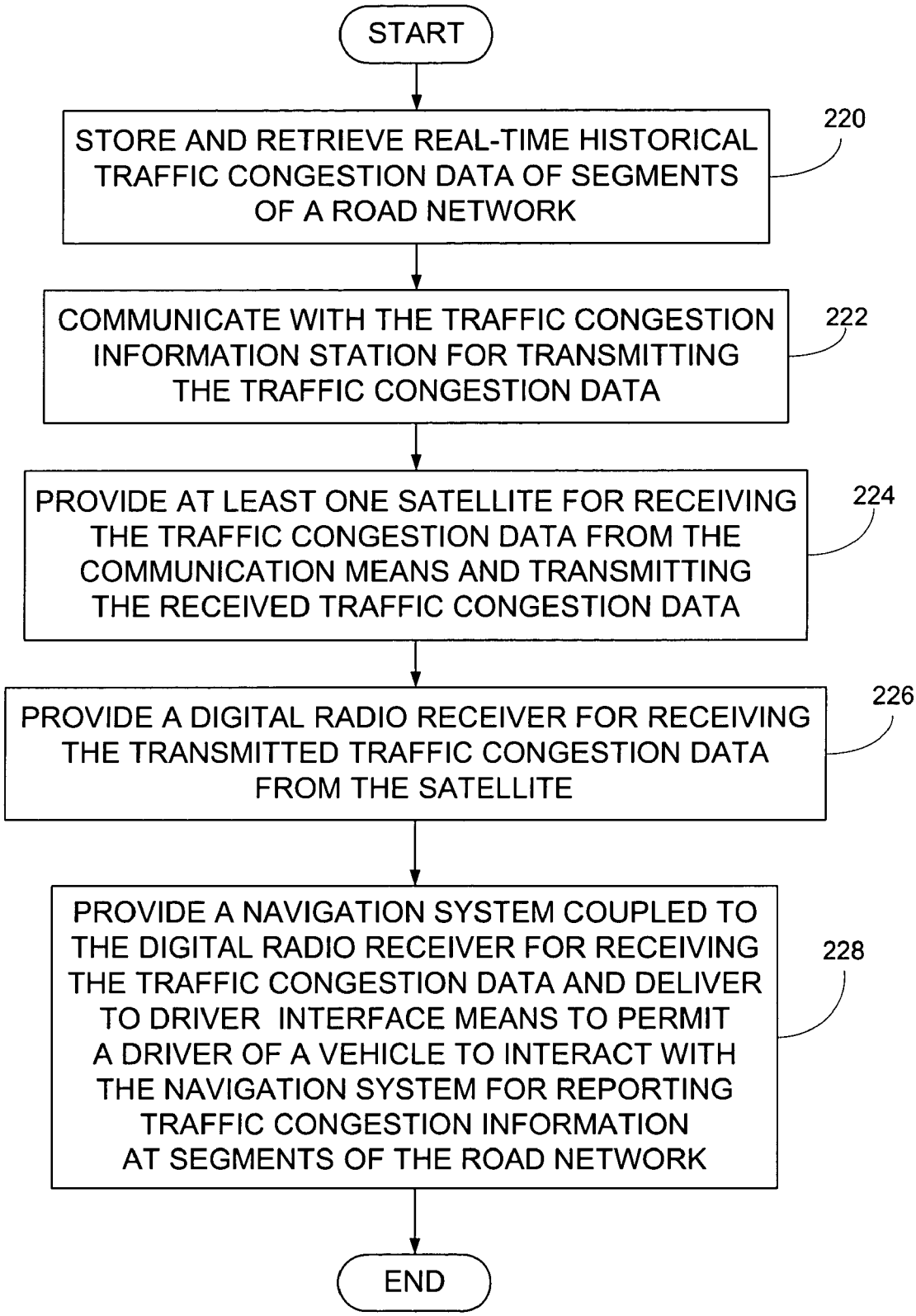
FIG. 4 is a flow chart illustrating exemplary process steps used to practice one embodiment of the present invention.

FIG. 4 is a flow chart depicting exemplary process steps used to practice one embodiment of the present invention. A first step, a traffic congestion information station stores and retrieves real-time traffic congestion data of segments of a road network, as shown in block 220. A second step, communication means is coupled with the traffic congestion information station for transmitting the traffic congestion data, as shown in block 222. A third step, a satellite is provided for receiving the traffic congestion data from the communication means and transmitting the received traffic congestion data, as shown in block 224. A fourth step, a digital radio receiver is provided for receiving the transmitted traffic congestion data from the satellite, as shown in block 226. A fifth step, a navigation system is provided and coupled to the digital receiver for receiving the traffic congestion data and delivering to driver interface means to permit a driver of a vehicle to interact with the navigation system for reporting traffic congestion information at segments of the road network, as shown in block 228.

Figure 5:
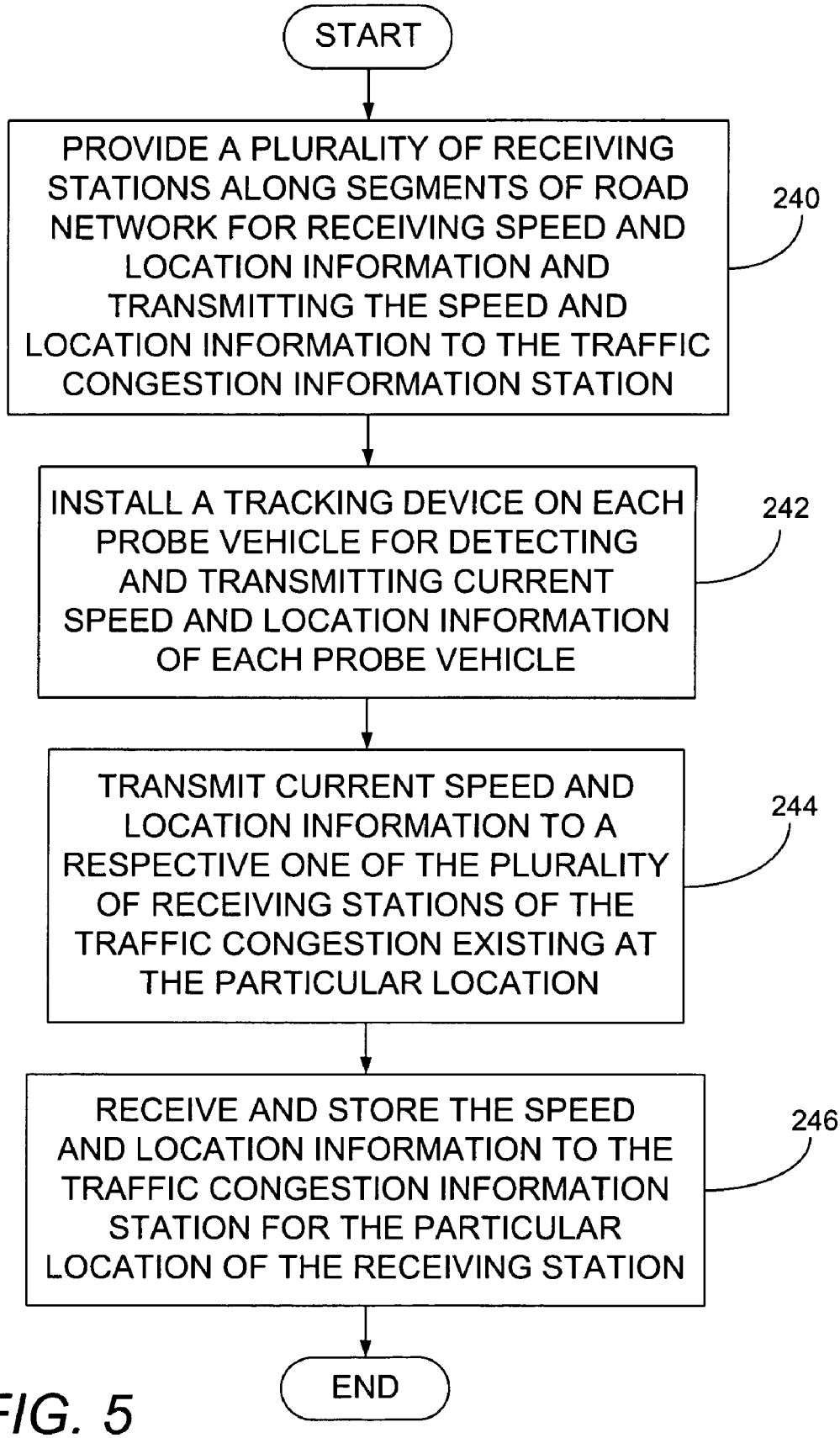
FIG. 5 is a flow chart depicting exemplary process steps used to practice another embodiment of the present invention.

FIG. 5 is a flow chart depicting exemplary process steps used to practice one embodiment of the present invention. A first step, a plurality of receiving stations are provided and spaced apart along the segments of the road network for receiving speed and location information and transmitting the speed and location information to the traffic congestion information station, as shown in block 240. A second step, a tracking device is installed on each of a plurality of probe vehicles for detecting and transmitting current speed and location information for each probe vehicle, as shown in block 242. A third step, a transmitter transmits the current speed and location information to a respective one of the plurality of receiving stations of the traffic congestion existing at the particular location, as shown in block 244. A fourth step, the traffic congestion information station receives and stores the speed and location information to the traffic congestion data station for the particular location of the receiving station, as shown in block 246.

Figure 6:
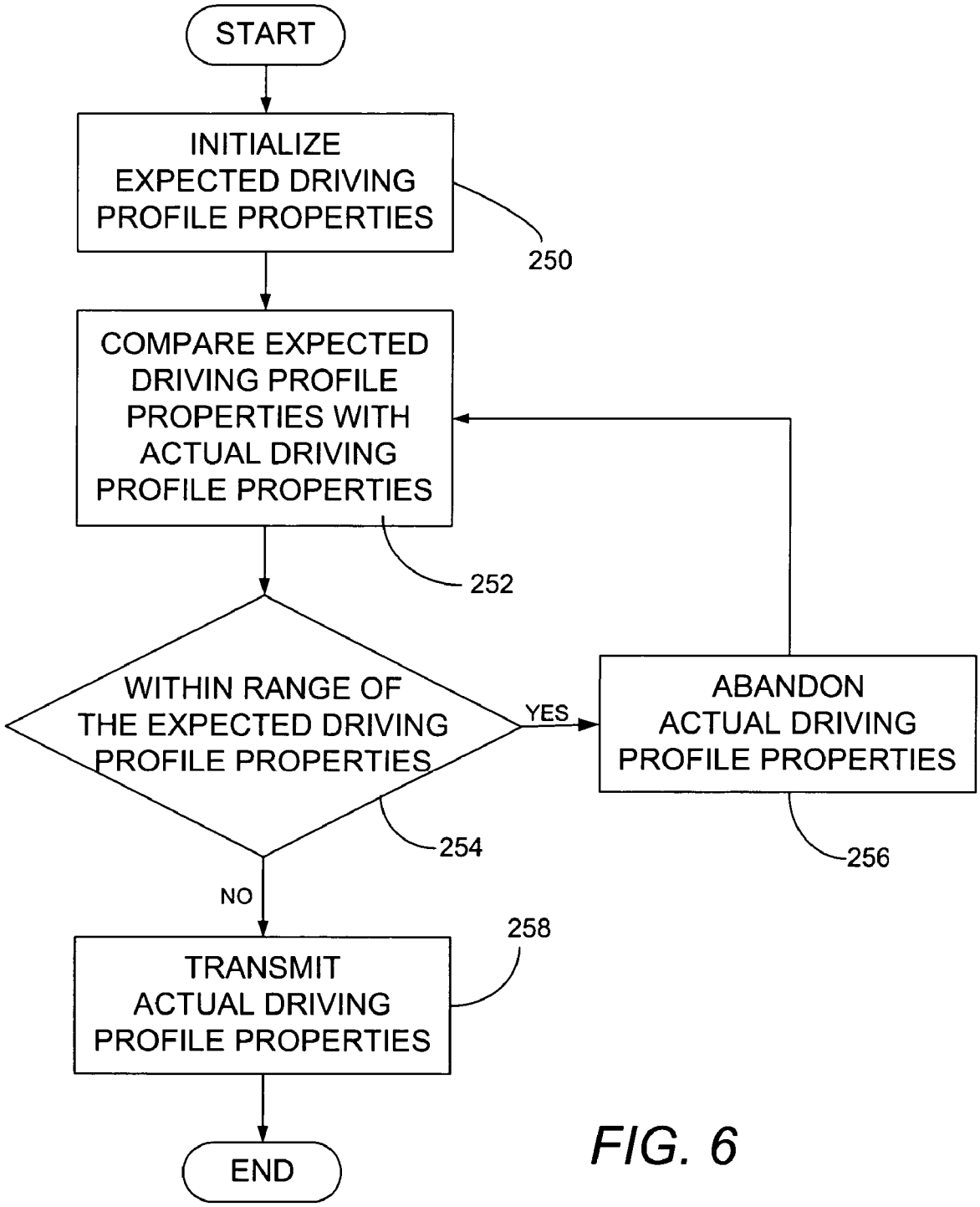
FIG. 6 is a flow chart illustrating exemplary process steps to determine when to transmit traffic congestion data.

FIG. 6 is a computer program which is comprised of instructions which, when read and executed by a computer, causes the computer to perform the steps necessary to compute and transmit the sensed traffic portion of the present invention. Optional, the program has instructions to reduce the bandwidth requirements. Computer program instructions may also be tangibly embodied in memory and/or data communication devices, thereby making a computer program product or article of manufacture according to the invention. As such, the terms "article of manufacture," "program storage device," and "computer program product" as used herein are intended to encompass a computer program accessible from any computer readable device or media. From the current actual driving profile, which is formed via the chronological sequence of data from sensor means, the computer program derives traffic congestion information. A processing means may include an integral circuit for determining the expected driving profile properties and the actual driving profile properties, as shown in block 250. A comparator means compares the actual driving properties with the expected driving profile properties, as shown in block 252. To assess the results of this comparison, suitable decision criteria are supplied to the comparator means from a memory, as shown in block 254. Depending on whether the comparison by the comparator means leads to the conclusion that a serious deviation from the expected traffic situation does (or does not) exist, a report is (or is not) sent to the traffic congestion information station via a transmitter, as shown in blocks 256 and 258. The comparator means recognizes these deviations and can determine based on the decision criteria that the data of the actual driving properties advantageously be transmitted to the traffic congestion information station because the actual deviations are impermissibly high. In this technique, it is possible to limit the scope of the traffic data transmitted by a plurality of probe vehicles for traffic situation assessment to a traffic station to a relatively low level.

This concludes the description of the preferred embodiments of the present invention. In summary, the present invention describes a method, apparatus and article of manufacture for utilizing satellites to transmit traffic congestion information to mobile users and/or utilizing power wireless transmitters to collect vehicle traffic congestion data.

The method comprises the steps of receiving and transmitting real-time traffic congestion data of the segments of the road network from a central traffic congestion information station having storage means; communicating with the central traffic information station for transmitting the traffic congestion data; providing at least one satellite having a digital radio transponder for receiving the traffic congestion data from the communicating step and transmitting the received traffic congestion data; providing a digital receiver for receiving the transmitted traffic congestion data from the at least one satellite; and providing a navigation system coupled to the digital radio receiver for receiving the transmitted traffic congestion data, processing the traffic congestion data and delivering to a driver interface means to permit mobile users to receive and/or interact with the navigation system for reporting traffic congestion information at the segments of the road network.

The method further comprises the steps of providing a plurality of receiving stations spaced apart along segments of a road network for receiving speed and location information and transmitting the speed and location information to a central traffic congestion information station; installing a tracking device on each of a plurality of probe vehicles for detecting and transmitting current speed and location information for each probe vehicle; transmitting the speed and location information to a respective one of the plurality of receiving stations of the traffic congestion existing at a particular location; and receiving and storing the speed and location information to the central traffic congestion information station for the particular location of the receiving station.

The present invention is a traffic congestion information distribution system. A central traffic congestion information station includes storage means or database for storing and retrieving real-time traffic congestion data of segments of a road network. An uplink communication means is coupled to the central traffic information station for transmitting the traffic congestion data. At least one satellite includes a digital transponder for receiving the traffic congestion data from the uplink communication means and transmitting the received traffic congestion data. A digital radio receiver receives the transmitted traffic congestion data from the at least one satellite. A navigation system is coupled to the digital radio receiver for receiving the transmitted traffic congestion data, processing the traffic congestion data and delivering to a driver interface means to permit a mobile user to receive and/or interact with the navigation system for reporting traffic congestion information at segments of the road network.

The present invention further comprises a traffic congestion data collection system. A plurality of receiving stations spaced apart along segments of a road network for receiving speed and location information and transmitting the speed and location information to a central traffic congestion information station. A tracking device is installed on each of a plurality of probe vehicles for detecting and transmitting current speed and location information for each probe vehicle. A transmitting means is coupled to the tracking device for transmitting the speed and location information to a respective one of the plurality of receiving stations of the traffic congestion existing at a particular location. The central traffic congestion information station receives and stores the speed and location information for the particular location of the receiving station.

CONCLUSION

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the composition of the invention. Since many embodiments of the invention can be made without departing form the spirit and scope of the invention, the invention resides in the claims hereinafter appended.

What is claimed is:

1. A system for communicating traffic information to a mobile user, comprising:

a traffic information station for aggregating and transmitting aggregated traffic information of segments of a road network;

an uplink communicator for transmitting said aggregated traffic information;

at least one satellite for receiving said aggregated traffic information from said uplink communicator and transmitting the received aggregated traffic information;

a receiver for receiving said transmitted aggregated traffic information from said at least one satellite;

a navigation system for receiving said transmitted aggregated traffic information, processing said traffic information and delivering to a driver interface to permit said mobile user to receive the navigation system for reporting traffic congestion information at said segments of said road network; and a system for collecting traffic information in segments of a road network and wireless transmission of the traffic information, the system comprising;

a plurality of receiving station spaced apart along said segments of said road network for receiving measured speed and location information and transmitting the measured speed and location information to said traffic information station;

a tracking device installed on each of a plurality of probe vehicles for detecting and transmitting measured speed and location information for said each probe vehicle;

a transmitter coupled to said tracking device for transmitting said measured speed and location information to a respective one of said plurality of receiving stations of the traffic congestion existing at a particular location; and wherein said traffic information station receives and stores said measured speed and location information from the receiving station.

2. The system of claim 1, wherein said driver interface includes an audio messager for producing audio user messages of said traffic congestion information.

3. The system of claim 1, wherein said driver interface includes a text display for displaying user text messages of said traffic congestion information.

4. The system of claim 1, wherein said driver interface includes a map display for displaying said traffic congestion information in graphic form superimposed over a freeway map.

5. The system of claim 1, further comprising a best route information to offer advice to faster route options to said mobile user.

6. The system of claim 5, wherein said best route information is visually displayed.

7. The system of claim 5, wherein said best route information is generated by audio.

8. The system of claim 1, wherein said tracking device further comprises:

a processor for receiving the measured speed and location information of said each probe vehicle and determining actual values and expected values of characteristic driving profile properties;

a comparator for comparing said actual values and said expected values of said characteristic driving profile properties and determining a difference between said actual values and said expected values;

a memory device including decision criteria; and wherein said transmitter for transmitting said measured speed and location information to the respective one of said plurality of receiving stations which in turn transmits to said traffic information station when said difference between said actual values and said expected values is determined to be a significant deviation from said expected values based on said decision criteria in said memory device.

9. A system for communicating traffic congestion information, comprising:

a plurality of receiving stations spaced apart along segments of a road network;

a tracking device installed on each of a plurality of probe vehicles which detects and transmits measured speed and location information for said each probe vehicle;

a transmitter coupled to said tracking device which transmits said measured speed and location information to a respective one of said plurality of receiving stations of the traffic congestion existing at a particular location; and a central traffic congestion information station which receives and stores said measured speed and location information for the particular location of the receiving station.

10. The system of claim 9, wherein said tracking device further comprises:

a processor for receiving the measured speed and location information of said each probe vehicle and determining actual values and expected values of characteristic driving profile properties;

a comparator for comparing said actual values and said expected values of said characteristic driving profile properties and determining a difference between said actual values and said expected values;

a memory device including decision criteria; and said transmitter for transmitting said measured speed and location information to the respective one of said plurality of receiving stations which in turn transmits to said central traffic congestion information station when said difference between said actual values and said expected values is determined to be a significant deviation from said expected values based on said decision criteria in said memory device.

11. The system of claim 9, wherein said transmitter includes a power wireless transmitter.

12. The system of claim 9, wherein the wireless transmitter is a low-power wireless transmitter.

13. The system of claim 9, wherein said central traffic congestion information station generates aggregated traffic congestion information from the measured speed and location information.

14. The system of claim 13, further comprising;

an uplink communicator which transmits said aggregated traffic congestion information from said central traffic congestion information station;

at least one satellite having a digital transponder which receives said aggregated traffic congestion information from said uplink communicator and transmits the aggregated traffic congestion information;

a radio receiver which receives said transmitted aggregated traffic congestion information from said at least one satellite; and a navigation system which receives and report said transmitted aggregated traffic congestion information.

15. A method of communicating traffic congestion information, comprising the steps of:

transmitting locally measured traffic congestion information to a central traffic congestion information station via a receiving station;

receiving aggregated traffic congestion information;

processing said locally measured traffic congestion information and determining actual values and expected values of characteristic driving profile properties;

comparing said actual values and said expected values of said characteristic driving profile properties and determining a difference between said actual values and said expected values;

providing a memory including decision criteria; and transmitting said measured traffic congestion information to said central traffic station via said receiving station when said difference between said actual values and said expected values is determined to be a significant deviation from said expected values based on said decision criteria in said memory.

16. The method of claim 15, wherein said transmitting step is performed by a wireless transmitter.

17. The method of claim 16, wherein the wireless transmitter comprises a low-power wireless transmitter.

18. A system for communicating traffic congestion information, comprising:

a plurality of receiving stations spaced apart along segments of a road;

a tracking device installed on each of a plurality of probe vehicles which detects and transmits measured speed and location information for said each probe vehicle;

a transmitter coupled to said tracking device which transmits said measured speed and location information to a respective one of said plurality of receiving stations; and a central traffic congestion information station which receives and stores said measured speed and location information from the receiving station.

19. The system of claim 18, wherein said tracking device further comprises:

a processor for receiving the measured speed and location information of said each probe vehicle and determining actual values and expected values of characteristic driving profile properties;

a comparator for comparing said actual values and said expected values of said characteristic driving profile properties and determining a difference between said actual values and said expected values;

a memory device including decision criteria; and said transmitter for transmitting said measured speed and location information to the respective one of said plurality of receiving stations according to a comparison between the difference and the decision criteria.

20. The system of claim 19, wherein said central traffic congestion information station generates aggregated traffic congestion information from the measured speed and location information.

21. The system of claim 20, further comprising:

an uplink communicator which transmits said aggregated traffic congestion information from said central traffic congestion information station;

at least one satellite having a digital transponder which receives said aggregated traffic congestion information from said uplink communicator and transmits the aggregated traffic congestion information;

a radio receiver which receives said transmitted aggregated traffic congestion information from said at least one satellite; and a navigation system which receives and report said transmitted aggregated traffic congestion information.

* * * * *